US011134545B2

(12) United States Patent
Pan et al.

(10) Patent No.: US 11,134,545 B2
(45) Date of Patent: Sep. 28, 2021

(54) HEATER ASSEMBLY

(71) Applicant: Tyco Electronics (Shanghai) Co. Ltd., Shanghai (CN)

(72) Inventors: Lei Pan, Shanghai (CN); Pai Rajendra, Bangalore (IN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/705,764

(22) Filed: Dec. 6, 2019

(65) Prior Publication Data

US 2020/0187306 A1 Jun. 11, 2020

(30) Foreign Application Priority Data

Dec. 7, 2018 (CN) ..... 201811500738.9

(51) Int. Cl.

| | |
|---|---|
| ***H05B 3/06*** | (2006.01) |
| ***H05B 3/42*** | (2006.01) |
| ***D06F 39/04*** | (2006.01) |
| ***A47L 15/42*** | (2006.01) |

(52) U.S. Cl.

CPC ..... *H05B 3/06* (2013.01); *H05B 3/42* (2013.01); *A47L 15/4285* (2013.01); *D06F 39/04* (2013.01); *H05B 2203/003* (2013.01); *H05B 2203/021* (2013.01)

(58) Field of Classification Search

CPC ..... H05B 3/06; H05B 3/42; H05B 2203/021; A47L 15/4285; D06F 39/04; H01R 13/6271; H01R 13/502; H01R 13/641; H01R 13/53

See application file for complete search history.

(56) References Cited

U.S. PATENT DOCUMENTS

| | | | | |
|---|---|---|---|---|
| 3,737,998 | A * | 6/1973 | Byrd | H01R 9/16 29/845 |
| 4,132,899 | A * | 1/1979 | Shigemasa | G01F 23/2925 250/577 |
| 4,191,877 | A * | 3/1980 | Tanaka | H05B 3/06 219/685 |
| 4,449,776 | A * | 5/1984 | Carmo | H01R 13/6271 439/350 |
| 2002/0155303 | A1* | 10/2002 | Wielstra | C09D 183/04 428/447 |
| 2005/0279141 | A1* | 12/2005 | Kim | D06F 39/04 68/12.22 |
| 2015/0201466 | A1* | 7/2015 | Sclip | H05B 45/00 219/209 |

* cited by examiner

*Primary Examiner* — Erin E McGrath
(74) *Attorney, Agent, or Firm* — Barley Snyder

(57) ABSTRACT

A heater assembly includes a heater having a pair of heating terminals, an integrated module, the heater is mounted on a first side of the integrated module and the heating terminals extend from a second side of the integrated module opposite to the first side, a ground terminal mounted on the second side of the integrated module and grounding the integrated module, and a connecting housing having a receiving portion. The ground terminal is arranged in a row with the heating terminals. The heating terminals and the ground terminal are inserted into the receiving portion through a bottom wall of the receiving portion.

18 Claims, 13 Drawing Sheets

HEATER ASSEMBLY

CROSS-REFERENCE TO RELATED APPLICATION

This application claims the benefit of the filing date under 35 U.S.C. § 119(a)-(d) of Chinese Patent Application No. 201811500738.9, filed on Dec. 7, 2018.

FIELD OF THE INVENTION

The present invention relates to a heater assembly and, more particularly, to a modular heater assembly.

BACKGROUND

A heater assembly is typically used to heat a target fluid, such as water, in some household appliances such as washing machines or dishwashers. However, in an existing heater assembly, a heater, a temperature sensor, and a ground terminal of a heater assembly are independent of each other and thus form separate plug-in units, resulting in a complicated structure, which is disadvantageous for assembly, disassembly, and maintenance.

SUMMARY

A heater assembly includes a heater having a pair of heating terminals, an integrated module, the heater is mounted on a first side of the integrated module and the heating terminals extend from a second side of the integrated module opposite to the first side, a ground terminal mounted on the second side of the integrated module and grounding the integrated module, and a connecting housing having a receiving portion. The ground terminal is arranged in a row with the heating terminals. The heating terminals and the ground terminal are inserted into the receiving portion through a bottom wall of the receiving portion.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
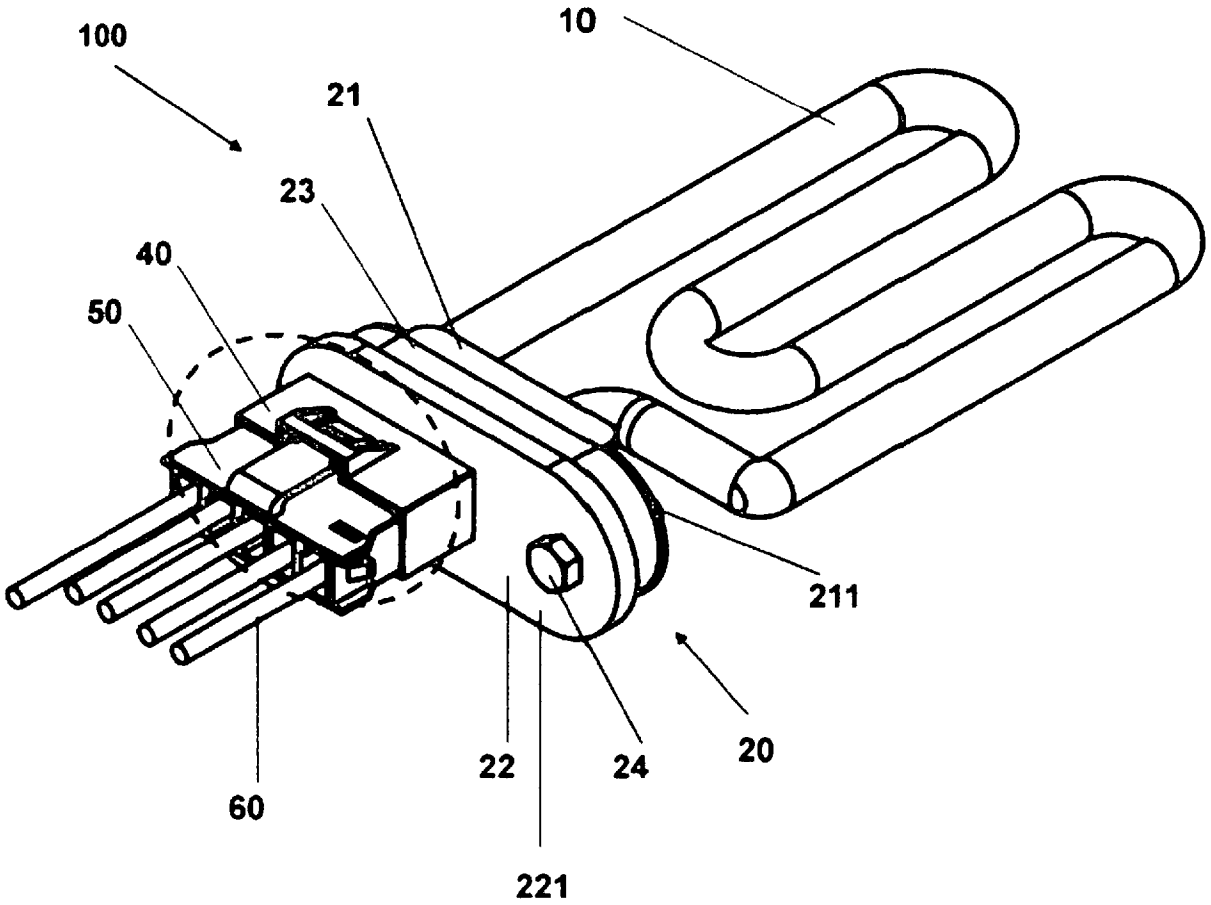
FIG. 1 is a perspective view of a heater assembly according to an embodiment.
Figure 2:
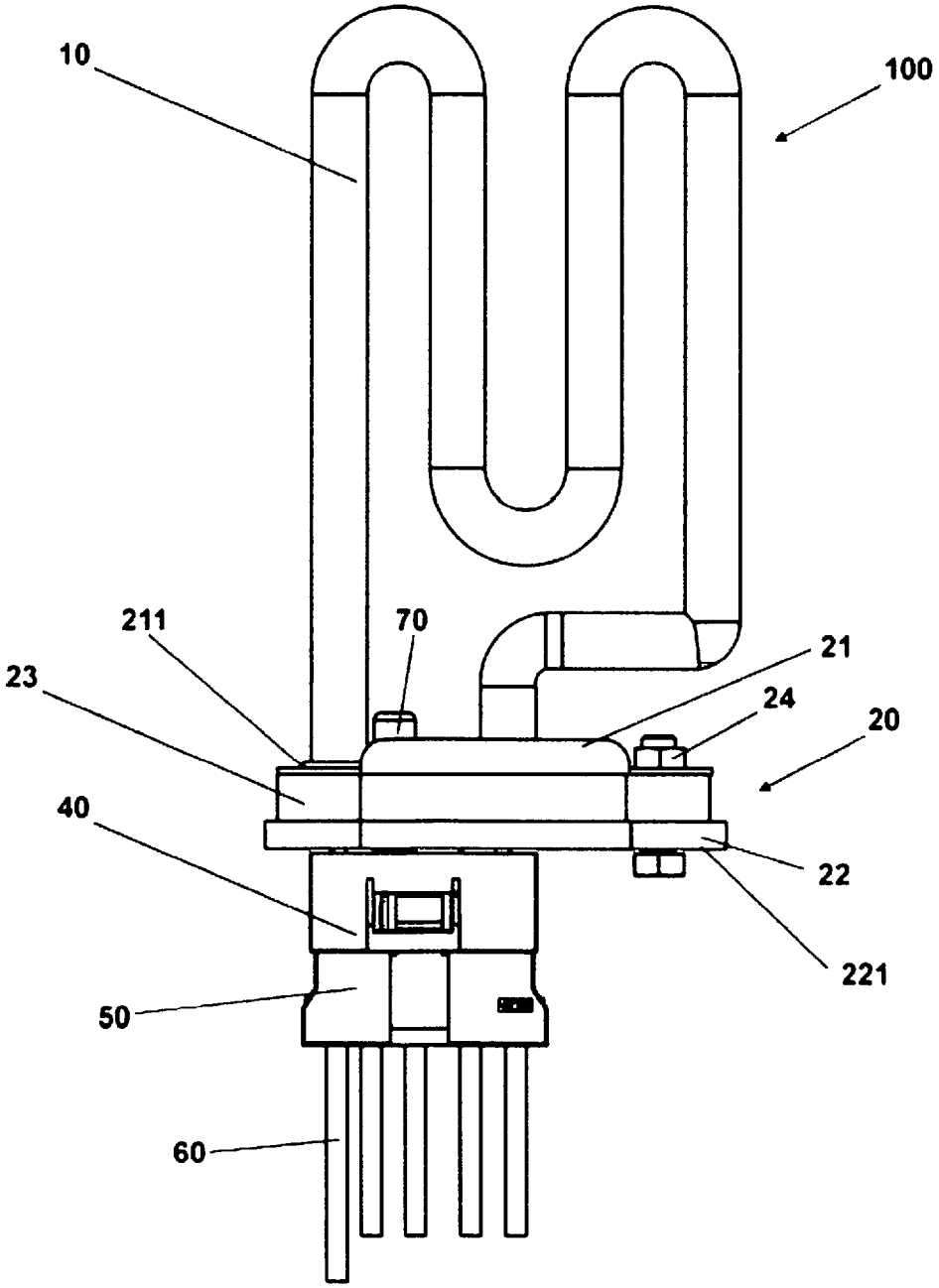
FIG. 2 is a top view of the heater assembly.

The technical solutions of the present disclosure will be specifically described below by way of embodiments and with reference to the accompanying drawings. In the specification, the same or similar reference numerals indicate the same or similar components. The description of the embodiments of the present disclosure with reference to the drawings is intended to be illustrative of concepts of the present disclosure, and is not to be construed as limiting the present disclosure.

In addition, in the following detailed description, numerous specific details are set forth to facilitate explanation so as to provide a comprehensive understanding of embodiments of the disclosure. Obviously, however, one or more embodiments may be practiced without these specific details. In other instances, well-known structures and devices are shown in form of charts so as to simplify the drawings.

A heater assembly 100 according to an embodiment, as shown in FIGS. 1-11, comprises a heater 10, an integrated module 20, a ground terminal 30, and a connecting housing 40.

The heater 10, as shown in FIGS. 3, 4, and 9-11, has a pair of heating terminals 11, 12. The heater 10 is mounted on a first side 211 of the integrated module 20 so as to heat an object, and the heating terminals 11, 12 extend from a second side 221 of the integrated module 20 opposite to the first side 211 so as to make an electrical connection.

Figure 3:
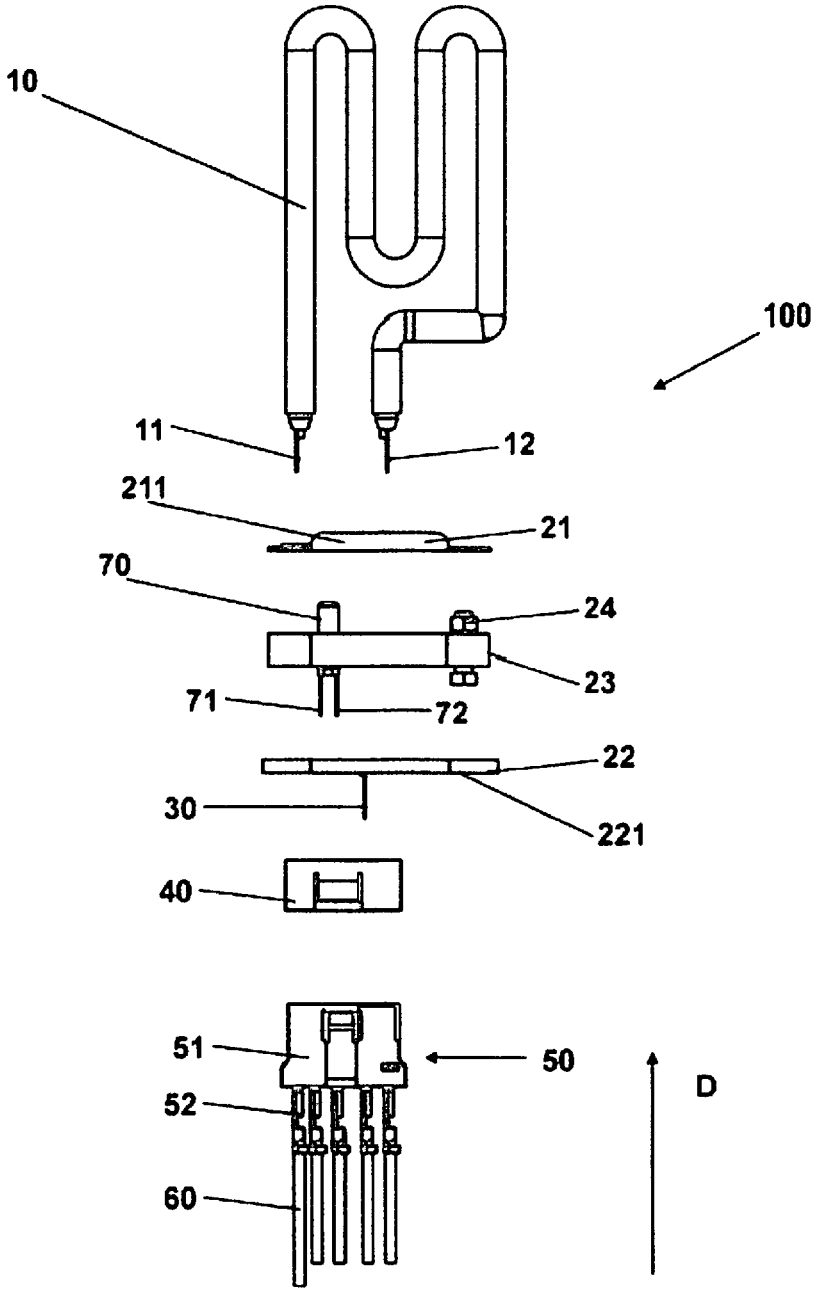
FIG. 3 is an exploded top view of the heater assembly.
Figure 4:
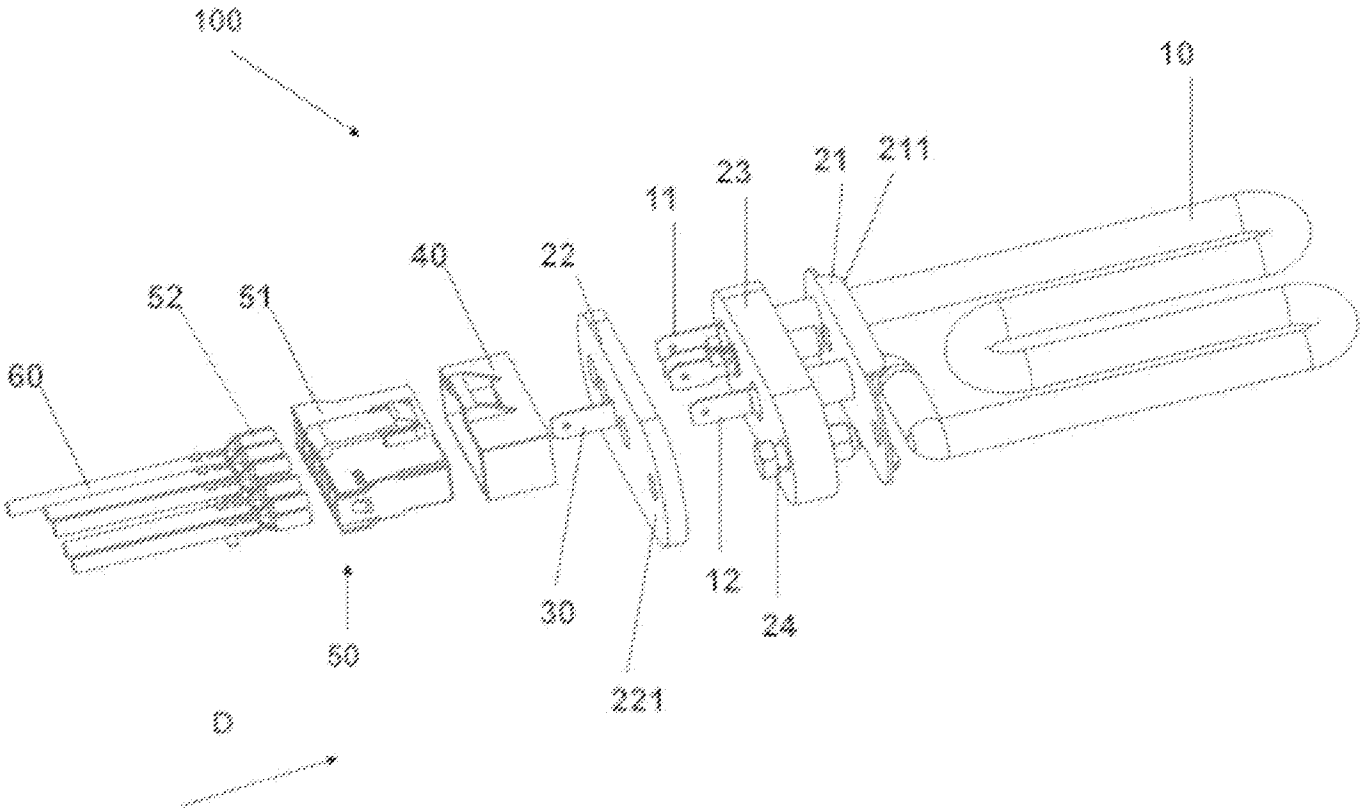
FIG. 4 is an exploded perspective view of the heater assembly.
Figure 9:
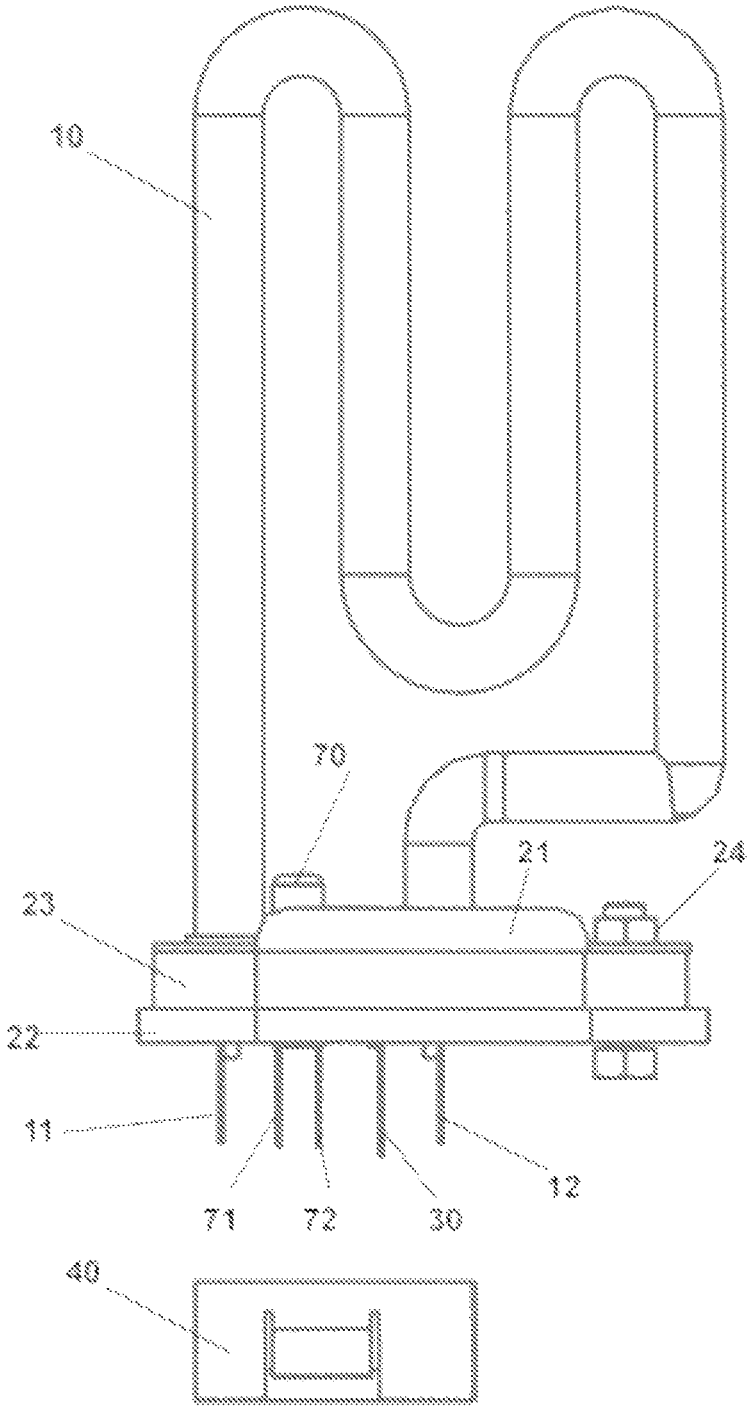
FIG. 9 is an exploded top perspective view of the heater assembly of FIG. 5.
Figure 10:
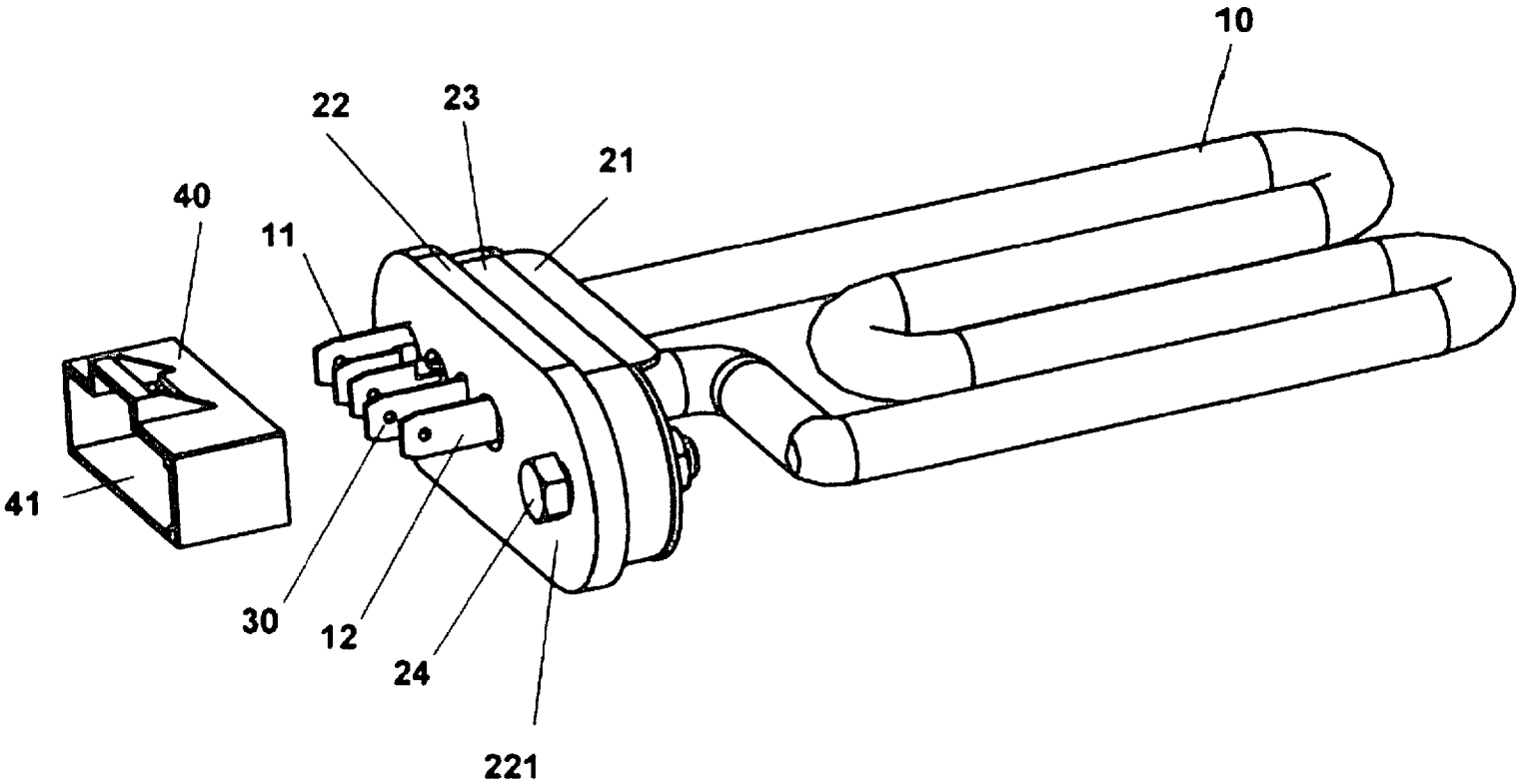
FIG. 10 is an exploded perspective view of the heater assembly of FIG. 5.

The ground terminal 30, as shown in FIG. 3, is mounted on the second side 221 of the integrated module 20 to ground the integrated module 20 so that electrostatic charges in the integrated module 20 are conducted to the ground through the ground terminal 30. The ground terminal 30 is arranged to be in a row with the heating terminals 11, 12, as shown in FIGS. 9-11.

Figure 5:
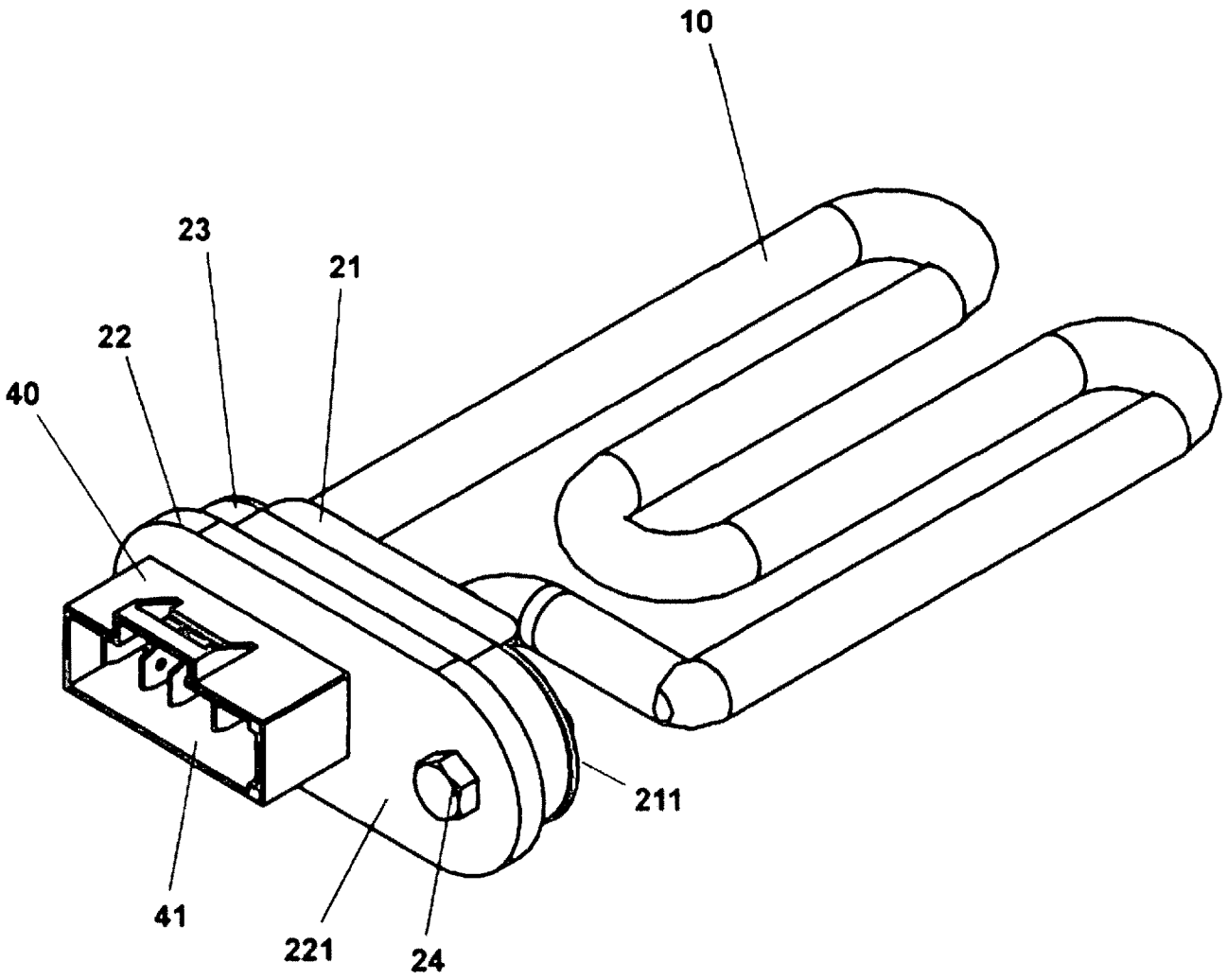
FIG. 5 is a perspective view of the heater assembly without a mating connector.
Figure 6:
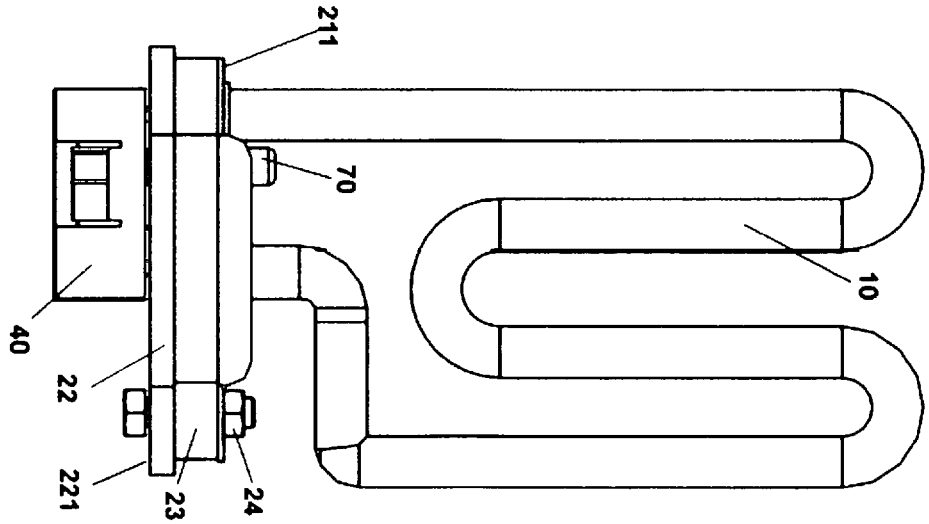
FIG. 6 is a top view of the heater assembly of FIG. 5.
Figure 7:
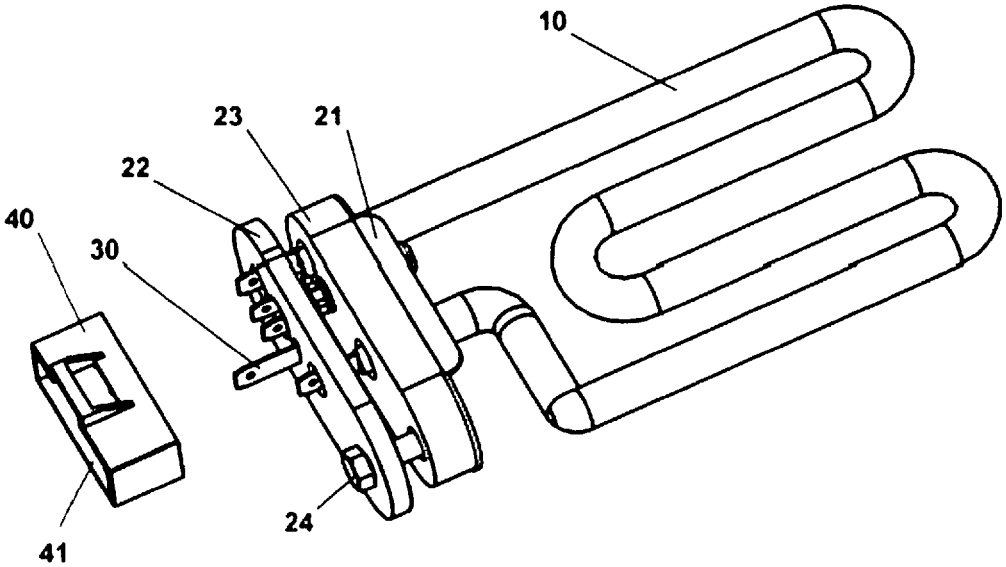
FIG. 7 is an exploded front perspective view of the heater assembly of FIG. 5.
Figure 8:
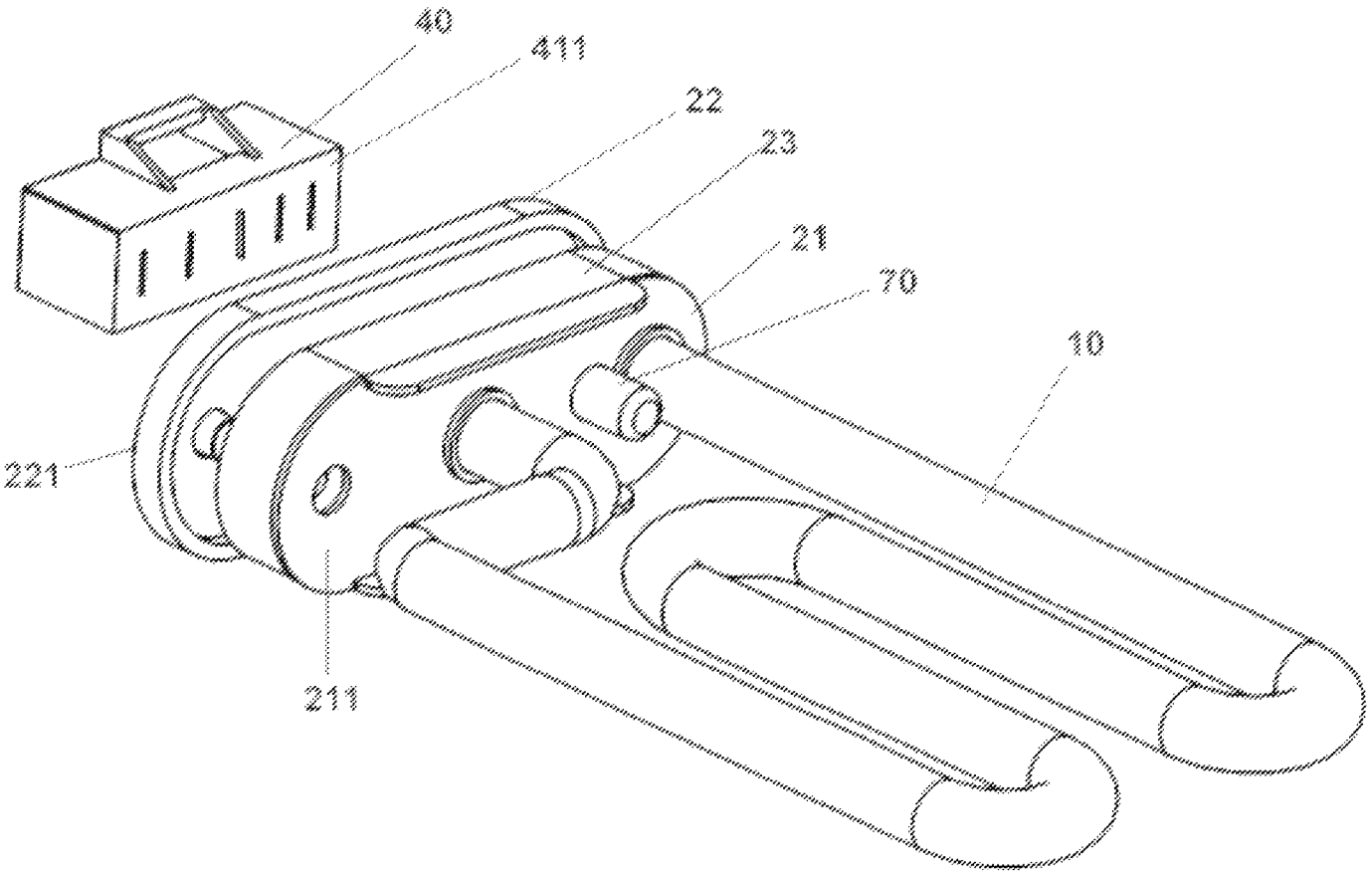
FIG. 8 is an exploded rear perspective view of the heater assembly of FIG. 5.
Figure 11:
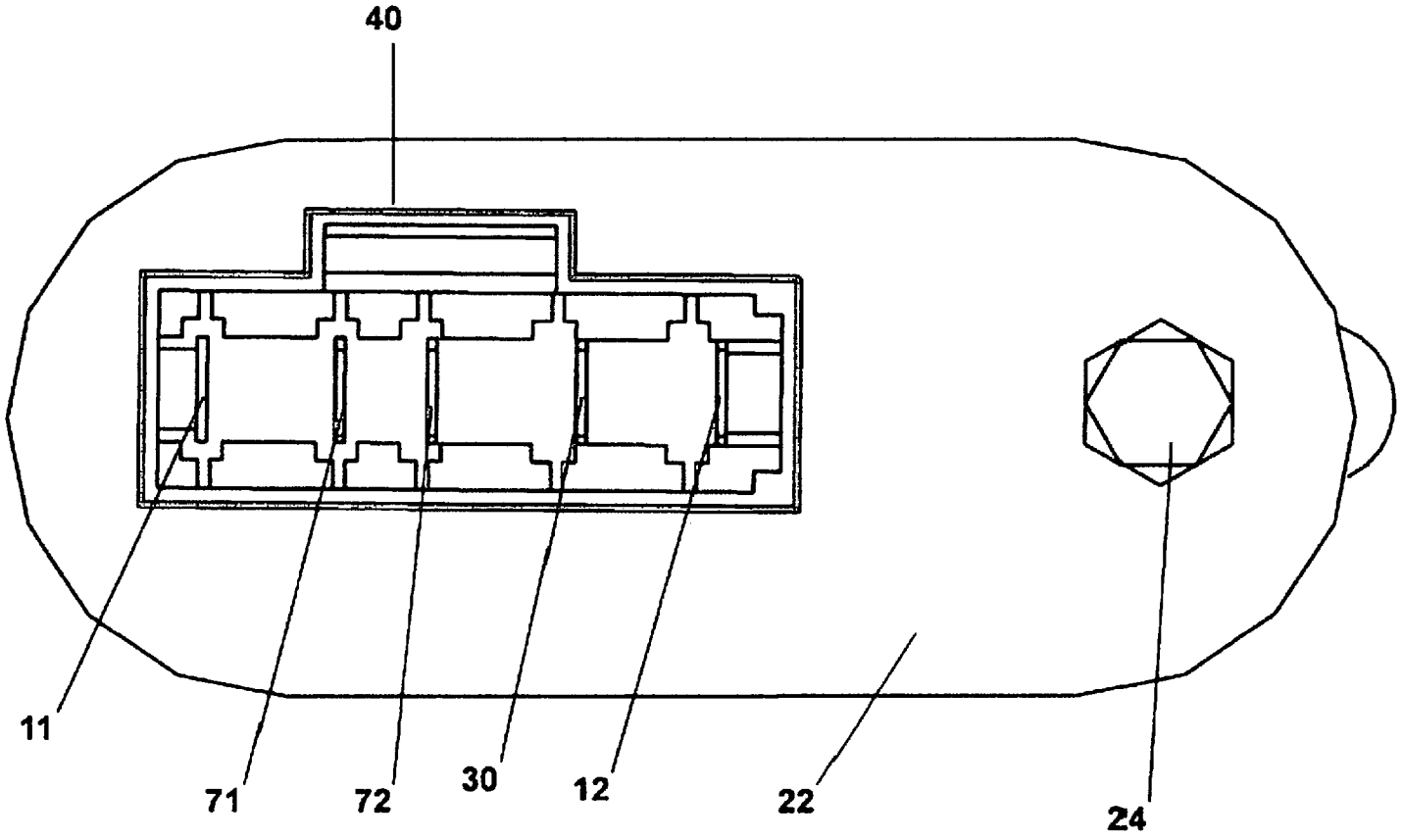
FIG. 11 is a front view of the heater assembly of FIG. 5.

The connecting housing 40 is provided with a receiving portion 41, the heating terminals 11, 12 and the ground terminal 30 are respectively inserted into the receiving portion 41 through a corresponding row of slots 4111 in a bottom wall 411 of the receiving portion 41, as shown in FIGS. 5, 8, and 11. At least one of the heating terminals 11, 12 and the ground terminal 30 is inserted into the receiving portion 41 in an interference fit with the corresponding slot 4111, so that the connecting housing 40 may be fixed onto the integrated module 20 while the least one terminal is connected to a corresponding cable 60. Thus, the assembly and disassembly of the connecting housing 40 is simplified. The heating terminals 11, 12 and the ground terminal 30 are arranged in a row and together in the receiving portion 41 of the same connecting housing 40, so that the heating terminals 11, 12 and the ground terminal 30 are integrally connected to the corresponding cables 60, respectively, which simplifies assembly and disassembly of the heater assembly 100 in an overall equipment and increases a utility of the heater assembly 100.

The heater assembly 100, as shown in FIGS. 1-4, comprises a mating connector 50 in an embodiment electrically connected to a plurality of the cables 60 and configured to be inserted into the receiving portion 41 in an insertion direction D. The mating connector 50 electrically connects the cables 60 to the heating terminals 11, 12 and the ground terminal 30 without separately electrically connecting the heating terminals 11, 12 and the ground terminal 30 to the corresponding cables 60, saving time for the assembly and disassembly of the heater assembly 100.

As shown in FIGS. 3, 4 and 12-13, the mating connector 50 includes a mating housing 51 having a plurality of receiving passages 511, and a plurality of mating terminals 52 respectively electrically connected to the cables 60 and received in the receiving passages 511 so as to be electrically connected to the heating terminals 11, 12 and the ground terminal 30. The receiving passages 511 are spaced apart from each other and thus may provide electrical insulation between the heating terminals 11, 12 and the ground terminal 30, preventing electrical connection or electrical breakdown between the heating terminals 11, 12 and the ground terminal 30, improving security of the heater assembly 100.

The connecting housing 40 and row of terminals 11, 12, 30 inserted therein, and the mating connector 50 electrically connected to the row of terminals 11, 12, 30 achieve a modular design of the heater assembly 100, such that the heater assembly 100 has a simple structure and is easy to be assembled and disassembled.

Figure 12:
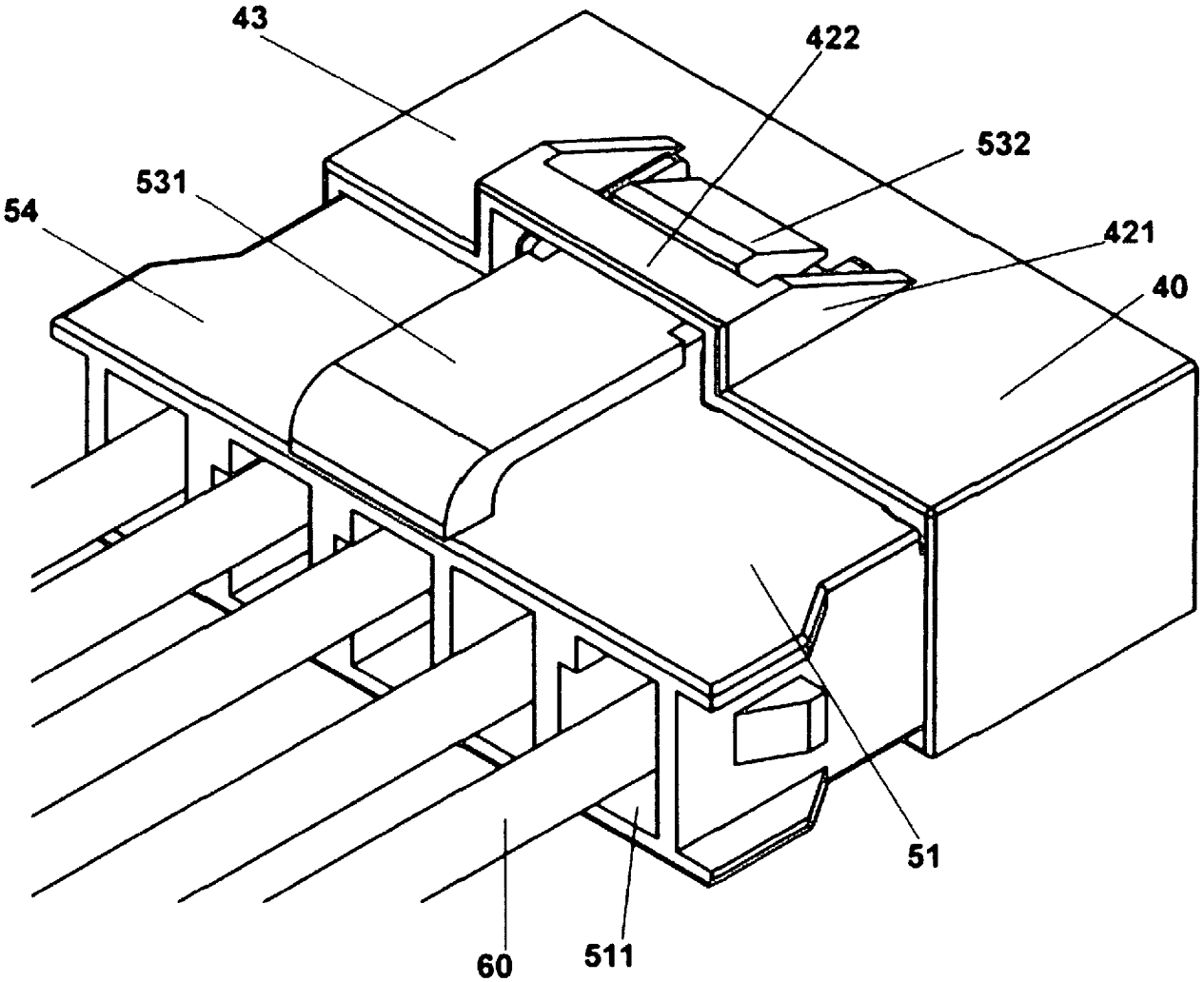
FIG. 12 is a perspective view of a portion of the heater assembly of FIG. 1 in a dashed circle.
Figure 13:
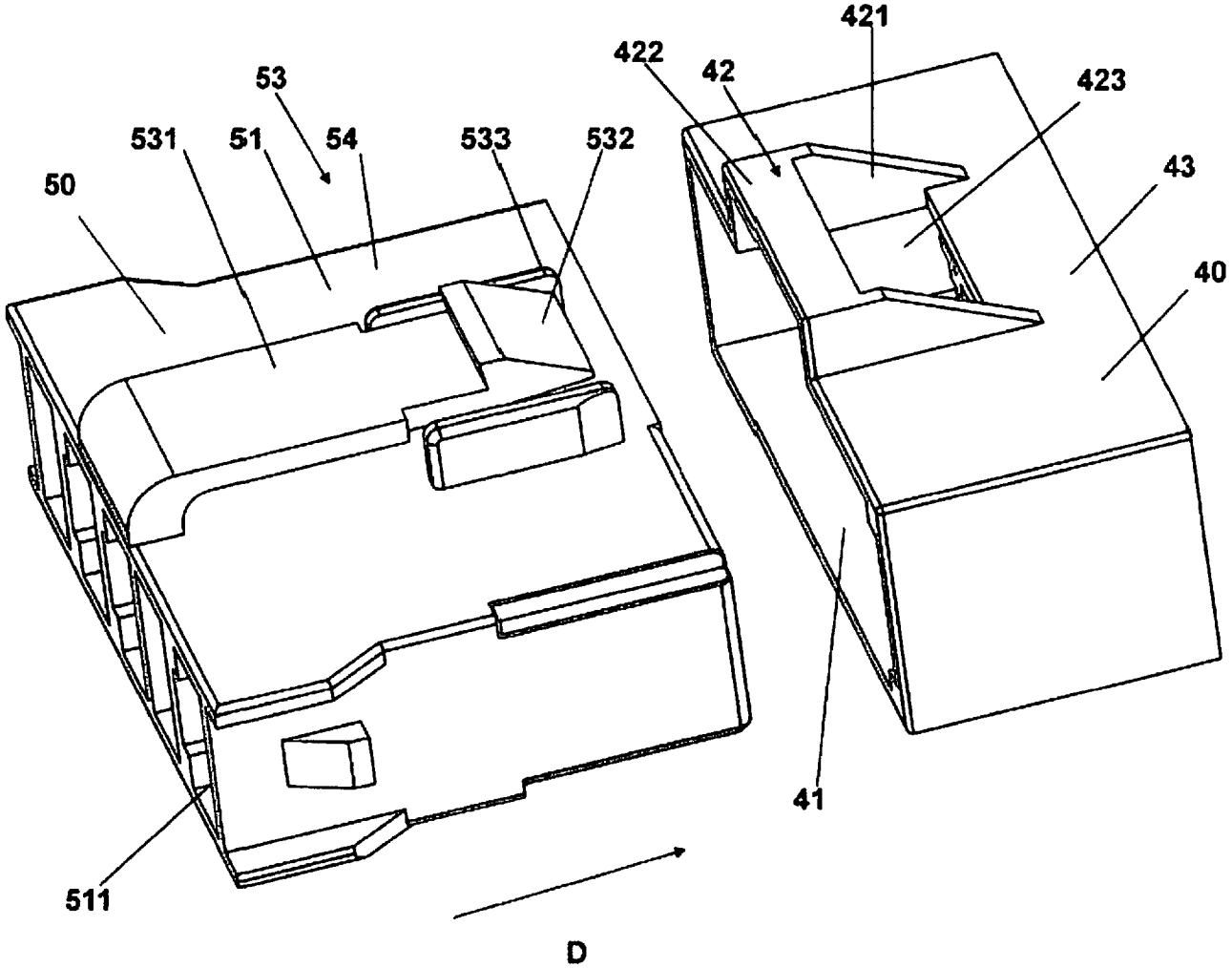
FIG. 13 is an exploded perspective view of a connecting housing and a mating housing of the portion of FIG. 12.

As shown in FIGS. 12 and 13, the connecting housing 40 has a locking mechanism 42, and the mating housing 51 has a mating locking mechanism 53 cooperating with the locking mechanism 42 so as to lock connection between the connecting housing 40 and the mating housing 51. The locking mechanism 42 includes a pair of first limiting walls 421 extending perpendicular to a side wall 43 of the connecting housing 40 and a blocking portion 422 connected between the two first limiting walls 421. The mating locking mechanism 53 includes a cantilever 531 extending from a side wall 54 of the mating housing 51 in the insertion direction D, at least a portion of the cantilever 531 being separated from the sidewall 54 of the mating housing 51 and a mating blocking portion 532 protruding from a free end of the cantilever 531. The mating blocking 532 is pressed by the blocking portion 422 when it comes into contact with the blocking portion 422, so that the free end of the cantilever 531 is moved downward toward the side wall 54 of the mating housing 51. The mating blocking 532 abuts against the blocking portion 422 after passing through a space between the blocking portion 422 of the locking mechanism 42 and the side wall 43 of the connecting housing 40, to lock the connecting housing 40 and the mating housing 51 in an engaged state. The first limiting wall 421 may prevent the mating blocking portion 532 from moving laterally along the blocking portion 422 so as to securely connect the mating housing 51 to the connecting housing 40.

Figure 14:
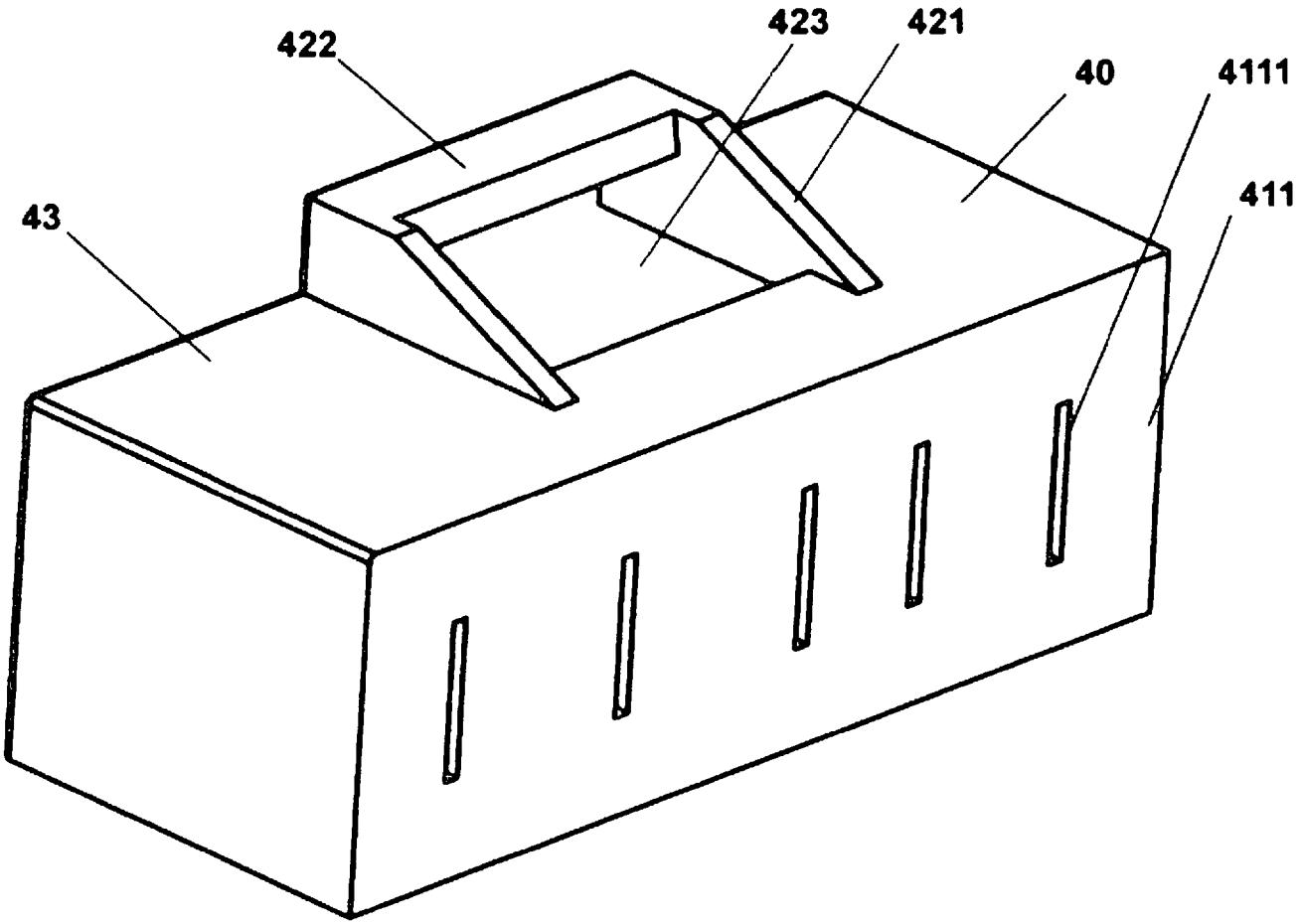
FIG. 14 is a rear view of the connecting housing of FIG. 13.

As shown in FIGS. 13 and 14, an opening 423 may be provided in a portion, which is located below the blocking portion 422 and between the two first limiting walls 421, of the side wall 43 of the connecting housing 40 so as to receive the mating blocking portion 532 when the mating blocking portion 532 is pressed downwards. The opening 423 improves the locking of the connecting housing 40 with the mating housing 51 when the mating housing 51 is inserted into the connecting housing 40, and eases pressing the mating locking portion 532 downwards to separate the connecting housing 40 from the mating housing 51 at the time of unlocking.

The mating connector 50, as shown in FIGS. 12 and 13, comprises a pair of second limiting walls 533 extending perpendicularly from the side walls 54 of the mating housing 51 and at opposite sides of the free end of the cantilever 531. The second limiting walls 533 are received in a space defined by the two first limiting walls 421 and the blocking portion 422. The two second limiting walls 533 prevent the free end of the cantilever 531 from moving laterally, so that the free end of the cantilever 531 may be accurately inserted into the space between the blocking portion 422 and the side wall 43 of the connecting housing 40 so as to abut against the blocking portion 422. The two second limiting walls 533 are arranged to abut against the two first limiting walls 421 at the inner sides of the two first limiting walls 421, respectively, so as to increase friction between the second limiting wall 533 and the first limiting wall 421 and further securely connect the mating housing 51 to the connecting housing 40.

In an embodiment, in order to facilitate temperature control of heating process, the mating connector 50, as shown in FIGS. 2, 3, 8, and 9, includes a temperature sensor 70 mounted on the first side 211 of the integrated module 20 for sensing a temperature of the heated object. A pair of detecting terminals 71, 72 of the temperature sensor 70 are inserted into the receiving portion 41 of the connecting housing 40 from the second side 221 of the integrated module 20 through the corresponding slots 4111, so as to be connected to the corresponding cables 60, respectively.

In the receiving portion 41 of the same connecting housing 40, the two detecting terminals 71, 72, the two heating terminals 11, 12, and the ground terminal 30 are arranged in a row. The detecting terminals 71, 72, the heating terminals 11, 12 and the ground terminal 30 are integrally or as a whole connected to the corresponding cables 60, simplifying the assembly and disassembly of the heater assembly 100 in an overall equipment and improving the utility of the heater assembly 100. In the embodiment shown in FIGS. 9-11, the two heating terminals 11, 12 are respectively located at the outermost side, and the ground terminal 30 is located between the two detecting terminals 71, 72 and one of the two heating terminals 11, 12. In other embodiments, the particular arrangement may differ according to actual needs. In an embodiment, the two detecting terminals 71, 72, the two heating terminals 11, 12 and the ground terminal 30 are all configured in the form of a plug-in sheet, so as to be mated with the mating terminals 52 to form electrical connections therebetween. This manner of forming a plug-in electrical connection is convenient and quick, further improving the utility of the heater assembly 100.

The heater 10 is a heating rod in an embodiment. Those skilled in the art will appreciate that, in other embodiments, the heater 10 can have any form suitable for use with the present disclosure; the heater may be constructed in any suitable form as desired.

The integrated module 20, as shown in FIGS. 1-10, includes a first cover 21, a second cover 22, an intermediate member 23 disposed between the first cover 21 and the second cover 22, and a fixing component 24 configured to assemble the first cover 21, the intermediate member 23, and the second cover 22 together into a whole. The ground terminal 30 is electrically connected to the second cover 22 in any suitable way, for example, by soldering or bonding or the like.

In an embodiment, the fixing component 24 is a conductive bolt that passes through the first cover 21, the intermediate member 23 and the second cover 22. The conductive bolt may conduct electrostatic charges from the first cover 21 to the ground through the ground terminal 30 on the second cover 22, enhancing safety of using the heater assembly 100.

The intermediate member 23 is made of a colloidal material in an embodiment, and both ends of an outer casing of the heater 10, the temperature sensor 70, and the conductive bolt are respectively inserted into the intermediate member 23. Use of the intermediate member 23 made of the colloidal material may not only mount the heater 10, the temperature sensor 70, and the conductive bolt more firmly into the integrated module 20, but also prevent any gap from forming between the first cover 21 and the second cover 22, thereby effectively improving the sealing and insulation of the integrated module 20.

In an embodiment, the first cover 21 and the second cover 22 are made of a metal material, and the conductive bolt is electrically connected to the first cover 21 and the second cover 22. A plurality of holes are provided in the first cover 21 and the second cover 22 to allow both ends of the outer casing of the heater 10 and the temperature sensor 70 to pass therethrough. Insulating gaskets may be respectively disposed in the plurality of holes respectively, or insertion positions where both ends of the outer casing of the heater 10 and the temperature sensor 70 are inserted into the intermediate member 23 are suitably arranged so that the heating terminals 11, 12 and the detecting terminals 71, 72 are completely exposed to the outside of the second cover 22, or the heating terminals 11, 12 and the detecting terminals 71, 72 are electrically insulated from the integrated module 20 respectively by other reasonable measures.

In an embodiment, the temperature sensor 70 is a negative temperature coefficient thermistor sensor. In other embodiments, those skilled in the art may use any suitable temperature sensor as needed.

In an embodiment, at least one terminal of the heating terminals 11, 12 and the detecting terminals 71, 72 is inserted into the receiving portion 41 in an interference fit with the bottom wall 411 of the receiving portion 41, so that the connecting housing 40 may be fixed to the integrated module 20 while the at least one terminal is connected to the corresponding cable 60, simplifying the assembly and disassembly of the connecting housing 40.

In an embodiment, projections (not shown), which protrude toward the receiving portion 41, are provided on an inner side of the bottom wall 411 of the receiving portion 41 at positions where the heating terminals 11, 12 and the detecting terminals 71, 72 are inserted into the receiving portion 41, so that the insulation between the heating terminals 11, 12 and the detecting terminals 71, 72 is enhanced while the connecting housing 40 is further fixed to the integrated module 20.

It will be understood by those skilled in the art that the embodiments described above are exemplary and may be modified by those skilled in the art, and the structures described in the various embodiments may be combined freely without conflicting in structure or principle thereof.

After a detailed description of the preferred embodiments of the present disclosure, those skilled in the art will clearly understand that various changes and modifications may be made without departing from the spirit and scope of the appended claims, and the present disclosure is not limited to implementations of the exemplary embodiments set forth in the specification.

What is claimed is:

1. A heater assembly, comprising:

a heater having a pair of heating terminals;

an integrated module having a first side on which the heater is mounted and a second side opposite the first side from which the heating terminals extend, the integrated module including:

a first cover;

a second cover;

an intermediate member located between the first cover and the second cover; and a fixing component passing through the first cover, the intermediate member, and the second cover for assembling the first cover, the intermediate member, and the second cover together into a whole;

a ground terminal mounted on the second side of the integrated module and grounding the integrated module, the ground terminal arranged in a row with the heating terminals and electrically connected to the second cover; and a connecting housing having a receiving portion, the heating terminals and the ground terminal are inserted into the receiving portion through a bottom wall of the receiving portion, wherein the first cover is a metal cover, the second cover is a metal cover and the fixing component is electrically connected to the first cover and the second cover.

2. The heater assembly of claim 1, further comprising a mating connector electrically connected to a plurality of cables and inserted into the receiving portion in an insertion direction, the mating connector electrically connecting the cables to the heating terminals and the ground terminal.

3. The heater assembly of claim 2, wherein the mating connector includes a mating housing having a plurality of receiving passages and a plurality of mating terminals electrically connected to the cables and received in the receiving passages, the mating terminals electrically connected with the heating terminals and the ground terminal.

4. The heater assembly of claim 3, wherein the connecting housing has a locking mechanism and the mating housing has a mating locking mechanism cooperating with the locking mechanism.

5. The heater assembly of claim 4, wherein the locking mechanism has a pair of first limiting walls extending perpendicularly to a side wall of the connecting housing and a blocking portion connected between the first limiting walls, the mating locking mechanism includes a cantilever extending from a side wall of the mating housing in the insertion direction, at least a portion of the cantilever being separated from the side wall of the mating housing, and a mating blocking portion protruding from a free end of the cantilever, the mating blocking portion abutting against the blocking portion after passing through a space between the blocking portion of the locking mechanism and the side wall of the connecting housing, locking the connecting housing and the mating housing in an engaged state.

6. The heater assembly of claim 5, wherein the mating connector has a pair of second limiting walls extending perpendicularly from the side wall of the mating housing and at opposite sides of the free end of the cantilever, the second limiting walls received in a space defined by the first limiting walls and the blocking portion.

7. The heater assembly of claim 1, further comprising a temperature sensor mounted on the first side of the integrated module, a pair of detecting terminals of the temperature sensor inserted into the receiving portion of the connecting housing from the second side of the integrated module.

8. The heater assembly of claim 7, wherein the detecting terminals, the heating terminals, and the ground terminal are arranged in a row.

9. The heater assembly of claim 1, wherein the heater includes a heating rod.

10. The heater assembly of claim 1, wherein the fixing component includes a conductive bolt.

11. The heater assembly of claim 1, wherein the intermediate member is made of a colloidal material, and a pair of ends of an outer casing of the heater are inserted into the intermediate member.

12. The heater assembly of claim 10, wherein the first cover and the second cover are each made of a metal material, the conductive bolt is electrically connected to the first cover and the second cover, and the heating terminals and the detecting terminals are electrically insulated from the integrated module.

13. The heater assembly of claim 7, wherein the temperature sensor includes a negative temperature coefficient thermistor sensor.

14. The heater assembly of claim 7, wherein at least one of the heating terminals and the detecting terminals is inserted into the receiving portion in interference fit with the bottom wall of the receiving portion.

15. The heater assembly of claim 14, wherein a plurality of projections are disposed on an inner side of the bottom wall of the receiving portion at positions where the heating terminals and the detecting terminals are inserted into the receiving portion.

16. The heater assembly of claim 8, wherein at least one of the heating terminals and the detecting terminals is inserted into the receiving portion in interference fit with the bottom wall of the receiving portion.

17. A heater assembly, comprising:

a heater having a pair of heating terminals;

an integrated module having a first side on which the heater is mounted and the heating terminals extend from a second side of the integrated module opposite to the first side;

a ground terminal mounted on the second side of the integrated module and grounding the integrated module, the ground terminal arranged in a row with the heating terminals;

a connecting housing having:

a locking mechanism including a pair of first limiting walls extending perpendicularly to a side wall of the connecting housing and a blocking portion connected between the first limiting walls; and a receiving portion, the heating terminals and the ground terminal are inserted into the receiving portion through a bottom wall of the receiving portion;

a mating connector electrically connected to a plurality of cables and inserted into the receiving portion in an insertion direction, the mating connector electrically connecting the cables to the heating terminals and the ground terminal and including a mating housing having a mating locking mechanism cooperating with the locking mechanism, the mating locking mechanism including:

a cantilever extending from a side wall of the mating housing in the insertion direction, at least a portion of the cantilever being separated from the side wall of the mating housing; and a mating blocking portion protruding from a free end of the cantilever, the mating blocking portion abutting against the blocking portion after passing through a space between the blocking portion of the locking mechanism and the side wall of the connecting housing, locking the connecting housing and the mating housing in an engaged state, wherein the mating connector has a pair of second limiting walls extending perpendicularly from the side wall of the mating housing and at opposite sides of the free end of the cantilever, the second limiting walls received in a space defined by the first limiting walls and the blocking portion.

18. A heater assembly, comprising:

a heater having a pair of heating terminals;

an integrated module having a first side on which the heater is mounted and a second side opposite the first side from which the heating terminals extend electrically insulated from the integrated module, the integrated module including:

a first cover;

a second cover;

an intermediate member located between the first cover and the second cover; and a fixing component configured to assemble the first cover, the intermediate member, and the second cover together into a whole;

a ground terminal mounted on the second side of the integrated module and grounding the integrated module, the ground terminal arranged in a row with the heating terminals and electrically connected to and extending from the second cover; and a connecting housing having a receiving portion, the heating terminals and the ground terminal are inserted into the receiving portion through a bottom wall of the receiving portion, wherein the first cover is a metal cover, the second cover is a metal cover and the fixing component is electrically connected to the first cover and the second cover.

* * * * *